US007209105B2

(12) United States Patent
Elliott

(10) Patent No.: US 7,209,105 B2
(45) Date of Patent: Apr. 24, 2007

(54) SYSTEM AND METHOD FOR COMPENSATING FOR VISUAL EFFECTS UPON PANELS HAVING FIXED PATTERN NOISE WITH REDUCED QUANTIZATION ERROR

(75) Inventor: Candice Hellen Brown Elliott, Vallejo, CA (US)

(73) Assignee: Clairvoyante, Inc, Sebastopol, CA (US)

( * ) Notice: Subject to any disclaimer, the term of this patent is extended or adjusted under 35 U.S.C. 154(b) by 401 days.

(21) Appl. No.: 10/455,927

(22) Filed: Jun. 6, 2003

(65) Prior Publication Data

US 2004/0246278 A1 Dec. 9, 2004

(51) Int. Cl.
*G09G 3/36* (2006.01)

(52) U.S. Cl. ..... 345/89; 345/694

(58) Field of Classification Search ..... 345/589, 345/89, 694–696, 698, 596
See application file for complete search history.

(56) References Cited

U.S. PATENT DOCUMENTS

| | | | |
|---|---|---|---|
| 3,971,065 | A | 7/1976 | Bayer |
| 4,353,062 | A | 10/1982 | Lorteije et al. |
| 4,642,619 | A | 2/1987 | Togashi |
| 4,651,148 | A | 3/1987 | Takeda et al. |
| 4,773,737 | A | 9/1988 | Yokono et al. |
| 4,781,438 | A | 11/1988 | Noguchi |
| 4,800,375 | A | 1/1989 | Silverstein et al. |
| 4,853,592 | A | 8/1989 | Strathman |
| 4,874,986 | A | 10/1989 | Menn et al. |
| 4,886,343 | A | 12/1989 | Johnson |
| 4,908,609 | A | 3/1990 | Stroomer |
| 4,920,409 | A | 4/1990 | Yamagishi |
| 4,965,565 | A | 10/1990 | Noguchi |
| 5,006,840 | A | 4/1991 | Hamada et al. |
| 5,052,785 | A | 10/1991 | Takimoto et al. |
| 5,097,297 | A | 3/1992 | Nakazawa |
| 5,113,274 | A | 5/1992 | Takahashi et al. |
| 5,144,288 | A | 9/1992 | Hamada et al. |
| 5,184,114 | A | 2/1993 | Brown |
| 5,191,451 | A | 3/1993 | Katayama et al. |
| 5,196,924 | A | 3/1993 | Lumelsky et al. |
| 5,311,205 | A | 5/1994 | Hamada et al. |
| 5,311,337 | A | 5/1994 | McCartney, Jr. |
| 5,315,418 | A | 5/1994 | Sprague et al. |
| 5,334,996 | A | 8/1994 | Tanigaki et al. |

(Continued)

FOREIGN PATENT DOCUMENTS

DE 299 09 537 U1 10/1999

(Continued)

OTHER PUBLICATIONS

Brown Elliott, C., "Active Matrix Display . . . ", IDMC 2000, 185-189, Aug. 2000.

(Continued)

*Primary Examiner*—Ricardo Osorio

(57) ABSTRACT

A system and method are disclosed for compensating for visual effects upon panels having non-standard polarity inversion schemes. A display comprises a panel comprising a plurality of subpixels. The panel has at least two subsets of same-colored subpixels having different electro-optical properties. The display also comprises separate quantizers for each of the at least two subsets of same-colored subpixels that can correct for fixed pattern noise.

38 Claims, 8 Drawing Sheets

U.S. PATENT DOCUMENTS 5,341,153 A 8/1994 Benzschawel et al.
5,398,066 A 3/1995 Martinez-Uriegas et al.
5,436,747 A 7/1995 Suzuki
5,438,649 A 8/1995 Ruetz
5,448,652 A 9/1995 Vaidyanathan et al.
5,450,216 A 9/1995 Kasson
5,459,595 A 10/1995 Ishiguro
5,461,503 A 10/1995 Deffontaines et al.
5,485,293 A 1/1996 Robinder
5,535,028 A 7/1996 Bae et al.
5,563,621 A 10/1996 Silsby
5,579,027 A 11/1996 Sakurai et al.
5,646,702 A 7/1997 Akinwande et al.
5,648,793 A 7/1997 Chen
5,739,802 A 4/1998 Mosier
5,754,163 A 5/1998 Kwon
5,754,226 A 5/1998 Yamada et al.
5,767,829 A 6/1998 Verhulst
5,808,594 A 9/1998 Tsuboyama et al.
5,818,405 A * 10/1998 Eglit et al. ..... 345/88
5,899,550 A 5/1999 Masaki
5,949,396 A 9/1999 Lee
5,949,496 A 9/1999 Kim
5,971,546 A 10/1999 Park
6,005,692 A 12/1999 Stahl
6,008,868 A 12/1999 Silverbrook
6,037,719 A 3/2000 Yap et al.
6,064,363 A 5/2000 Kwon
6,069,670 A 5/2000 Borer
6,088,050 A * 7/2000 Ng ..... 347/237
6,097,367 A 8/2000 Kuriwaki et al.
6,100,872 A 8/2000 Aratani et al.
6,108,122 A 8/2000 Ulrich et al.
6,144,352 A 11/2000 Matsuda et al.
6,147,664 A 11/2000 Hansen
6,151,001 A 11/2000 Anderson et al.
6,160,535 A 12/2000 Park
6,188,385 B1 2/2001 Hill et al.
6,219,019 B1 4/2001 Hasegawa et al.
6,219,025 B1 4/2001 Hill et al.
6,225,967 B1 5/2001 Hebiguchi
6,225,973 B1 5/2001 Hill et al.
6,236,390 B1 5/2001 Hitchcock
6,239,783 B1 5/2001 Hill et al.
6,243,055 B1 6/2001 Fergason
6,243,070 B1 6/2001 Hill et al.
6,278,434 B1 8/2001 Hill et al.
6,326,981 B1 12/2001 Mori et al.
6,327,008 B1 12/2001 Fujiyoshi
6,332,030 B1 12/2001 Manjunath et al.
6,335,719 B1 1/2002 An et al.
6,342,876 B1 * 1/2002 Kim ..... 345/87
6,348,929 B1 2/2002 Acharya et al.
6,377,262 B1 4/2002 Hitchcock et al.
6,388,644 B1 5/2002 De Zwart et al.
6,392,717 B1 5/2002 Kunzman
6,393,145 B2 5/2002 Betrisey et al.
6,396,505 B1 5/2002 Lui et al.
6,441,867 B1 8/2002 Daly
6,469,766 B2 10/2002 Waterman et al.
6,545,653 B1 4/2003 Takahara et al.
6,552,706 B1 4/2003 Ikeda et al.
6,570,584 B1 5/2003 Cok et al.
6,590,555 B2 7/2003 Su et al.
6,624,828 B1 9/2003 Dresevic et al.
6,661,429 B1 12/2003 Phan
6,674,430 B1 1/2004 Kaufman et al.
6,674,436 B1 1/2004 Dresevic et al.
6,680,761 B1 1/2004 Greene et al.
6,714,206 B1 3/2004 Martin et al.
6,714,212 B1 3/2004 Tsuboyama et al.
6,714,243 B1 3/2004 Mathur et al.
6,738,204 B1 5/2004 Chuang et al.
6,750,875 B1 6/2004 Keely, Jr. et al.
6,771,028 B1 8/2004 Winters
6,781,600 B2 * 8/2004 Anwar ..... 345/629
6,804,407 B2 10/2004 Weldy
6,833,890 B2 12/2004 Hong et al.
6,836,300 B2 12/2004 Choo et al.
6,850,294 B2 2/2005 Roh et al.
6,867,549 B2 3/2005 Cok et al.
6,885,380 B1 4/2005 Primerano et al.
6,888,604 B2 5/2005 Rho et al.
6,897,876 B2 5/2005 Murdoch et al.
6,903,378 B2 6/2005 Cok
6,961,040 B2 * 11/2005 Ohashi et al. ..... 345/88
6,995,346 B2 2/2006 Johanneson et al.
2001/0015716 A1 8/2001 Kim
2001/0017607 A1 8/2001 Kwon et al.
2002/0093476 A1 7/2002 Hill et al.
2002/0158997 A1 10/2002 Fukami et al.
2003/0006978 A1 1/2003 Fujiyoshi
2003/0011603 A1 1/2003 Koyama et al.
2003/0071943 A1 4/2003 Choo et al.
2003/0077000 A1 4/2003 Blinn et al.
2003/0146893 A1 * 8/2003 Sawabe ..... 345/89
2003/0218618 A1 11/2003 Phan
2004/0008208 A1 1/2004 Dresevic et al.
2004/0012551 A1 * 1/2004 Ishii ..... 345/87
2004/0021804 A1 2/2004 Hong et al.
2004/0061710 A1 4/2004 Messing et al.
2004/0094766 A1 * 5/2004 Lee et al. ..... 257/72
2004/0095521 A1 5/2004 Song et al.
2004/0114046 A1 6/2004 Lee et al.
2001/0052897 A1 7/2004 Nakano et al.
2004/0150651 A1 8/2004 Phan
2004/0155895 A1 8/2004 Lai
2004/0169807 A1 9/2004 Rho et al.
2004/0174389 A1 9/2004 Ben-David et al.
2004/0179160 A1 9/2004 Rhee et al.
2004/0189662 A1 9/2004 Frisken et al.
2004/0189664 A1 9/2004 Frisken et al.
2004/0213449 A1 10/2004 Safee-Rad et al.
2004/0223005 A1 11/2004 Lee
2004/0239813 A1 12/2004 Klompenhouwer
2004/0239837 A1 12/2004 Hong et al.
2004/0246213 A1 12/2004 Credelle et al.
2004/0246278 A1 12/2004 Elliott
2004/0246280 A1 12/2004 Credelle et al.
2004/0246381 A1 12/2004 Credelle
2004/0246404 A1 12/2004 Elliott et al.
2004/0247070 A1 12/2004 Ali et al.
2005/0007539 A1 1/2005 Taguchi et al.
2005/0024380 A1 2/2005 Lin et al.
2005/0040760 A1 2/2005 Taguchi et al.
2005/0068477 A1 3/2005 Shin et al.
2005/0083356 A1 4/2005 Roh et al.
2005/0140634 A1 6/2005 Takatori
2005/0151752 A1 7/2005 Phan
2005/0162600 A1 7/2005 Rho et al.
2005/0219274 A1 10/2005 Yang et al.

FOREIGN PATENT DOCUMENTS

DE 199 23 527 11/2000
DE 201 09 354 U1 9/2001
EP 0 322 106 A2 6/1989
EP 1 381 020 A2 1/2004
JP 60-107022 6/1985
JP 02-983027 B2 4/1991
JP 03-78390 4/1991
JP 06-102503 4/1994
JP 08-202317 8/1996
JP 11-282008 10/1999

| | | | |
|---|---|---|---|
| JP | 2004-004822 | | 1/2004 |
| WO | WO 2004/021323 | A2 | 3/2004 |
| WO | WO 2004/027503 | A1 | 4/2004 |
| WO | WO 2004/086128 | A1 | 10/2004 |
| WO | WO 2005/050296 | A1 | 6/2005 |

OTHER PUBLICATIONS

Brown Elliott, C., "Color Subpixel Rendering Projectors and Flat Panel Displays," SMPTE, Feb. 27-Mar. 1, 2003, Seattle, WA pp. 1-4.
Brown Elliott, C, "Co-Optimization of Color AMLCD Subpixel Architecture and Rendering Algorithms," SID 2002 Proceedings Paper, May 30, 2002 pp. 172-175.
Brown Elliott, C, " Development of the PenTile Matrix™ Color AMLCD Subpixel Architecture and Rendering Algorithms", SID 2003, Journal Article.
Brown Elliott, C, "New Pixel Layout for PenTile Matrix™ Architecture", IDMC 2002, pp. 115-117.
Brown Elliott, C, "Pentile Matirx™ Displays and Drivers" ADEAC Proceedings Paper, Portland OR., Oct. 2005.
Brown Elliott, C, "Reducing Pixel Count Without Reducing Image Quality", Information Display Dec. 1999, vol. 1, pp. 22-25.
Credelle, Thomas, "P-00: MTF of High-Resolution PenTile Matrix Displays", Eurodisplay 02 Digest, 2002 pp. 1-4.
Daly, Scott, "Analysis of Subtriad Addressing Algorithms by Visual System Models", SID Symp. Digest, Jun. 2001 pp. 1200-1203.
Klompenhouwer, Michiel, Subpixel Image Scaling for Color Matrix Displays, SID Symp. Digest, May 2002, pp. 176-179.
Krantz, John et al., Color Matrix Display Image Quality: The Effects of Luminance . . . SID 90 Digest, pp. 29-32.
Lee, Baek-woon et al., 40.5L: Late-News Paper: TFT-LCD with RGBW Color system, SID 03 Digest, 2003, pp. 1312-1215.
Messing, Dean et al., Improved Display Resolution of Subsampled Colour Images Using Subpixel Addressing, IEEE ICIP 2002, vol. 1, pp. 625-628.
Messing, Dean et al., Subpixel Rendering on Non-Striped Colour Matrix Displays, 2003 International Conf on Image Processing, Sep. 2003, Barcelona, Spain, 4 pages.
Okumura et al., "A New Flicker-Reduction Drive Method for High Resolution LCTVs", SID Digest,pp. 551-554, 2001.
UPSTO, Non-Final Office Action dated Oct. 19, 2005 in US Patent Publication No. 2004/0246279 (U.S. Appl. No. 10/456,806).
Clairvoyante Inc, Response to Non-Final Office Action dated Jan. 18, 2005 in US Patent Publication No. 2004/0246279 (U.S. Appl. No. 10/456,806).
UPSTO, Final Office Action dated May 2, 2006 in US Patent Publication No. 2004/0246279 (U.S. Appl. No. 10/456,806).
UPSTO, Non-Final Office Action dated Mar. 20, 2006 in US Patent Publicaton No. 2004/0246280 (U.S. Appl. No. 10/456,839).
Clairvoyante Inc, Response to Non-Final Office Action dated Jun. 20, 2006 in US Patent Publication No. 2004/0246280 (U.S. Appl. No. 10/456,839).
UPSTO, Non-Final Office Action dated May 4, 2006 in US Patent Publication No. 2005/0083277 (U.S. Appl. No. 10/696,236).

* cited by examiner

Φ1: +-+-+-...

Φ2: -+-+-+...

SYSTEM AND METHOD FOR COMPENSATING FOR VISUAL EFFECTS UPON PANELS HAVING FIXED PATTERN NOISE WITH REDUCED QUANTIZATION ERROR

RELATED APPLICATIONS

The present application is related to commonly owned United States Patent Applications: (1) U.S. patent application Ser. No. 10/455,925 entitled "DISPLAY PANEL HAVING CROSSOVER CONNECTIONS EFFECTING DOT INVERSION", now published as U.S. Patent Application 2004/0246213; (2) U.S. patent application Ser. No. 10/455,931 entitled "SYSTEM AND METHOD OF PERFORMING DOT INVERSION WITH STANDARD DRIVERS AND BACKPLANE ON NOVEL DISPLAY PANEL LAYOUTS", now published as U.S. Patent Application 2004/0246381; (3) U.S. patent application Ser. No. 10/456,806 entitled "DOT INVERSION ON NOVEL DISPLAY PANEL LAYOUTS WITH EXTRA DRIVERS", now published as U.S. Patent Application 2004/0246279; (4) U.S. patent application Ser. No. 10/456,838 entitled "LIQUID CRYSTAL DISPLAY BACKPLANE LAYOUTS AND ADDRESSING FOR NON-STANDARD SUBPIXEL ARRANGEMENTS", now published as U.S. Patent Application 2004/0246404; and (5) U.S. patent application Ser. No. 10/456,839 entitled "IMAGE DEGRADATION CORRECTION IN NOVEL LIQUID CRYSTAL DISPLAYS," now published as U.S. Patent Application 2004/0246280, which are hereby incorporated herein by reference.

BACKGROUND

In commonly owned United States Patents and Patent Application Publications: (1) U.S. patent application Ser. No. 09/916,232, now issued as U.S. Pat. No. 6,903,754 ("the '754 patent"), entitled "ARRANGEMENT OF COLOR PIXELS FOR FULL COLOR IMAGING DEVICES WITH SIMPLIFIED ADDRESSING," filed Jul. 25, 2001; (2) U.S. Patent Application Publication 2003/0128225 (application Ser. No. 10/278,353) ("the '225 application"), entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) U.S. Patent Application Publication 2003/0128179 (application Ser. No. 10/278,352) ("the '179 application"), entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) U.S. Patent Application Publication 2004/0051724) (application Ser. No. 10/243,094) ("the '724 application), entitled "IMPROVED FOUR COLOR ARRANGEMENTS AND EMITTERS FOR SUB-PIXEL RENDERING," filed Sep. 13, 2002; (5) U.S. Patent Application Publication 2003/0117423 (application Ser. No. 10/278,328) ("the '423 application"), entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) U.S. Patent Application Publication 2003/0090581 (application Ser. No. 10/278,393) ("the '581 application"), entitled "COLOR DISPLAY HAVING HORIZONTAL SUB-PIXEL ARRANGEMENTS AND LAYOUTS," filed Oct. 22, 2002; (7) U.S. Patent Application Publication 2004/0080479 (application Ser. No. 10/347,001) ("the '479 application") entitled "SUB-PIXEL ARRANGEMENTS FOR STRIPED DISPLAYS AND METHODS AND SYSTEMS FOR SUB-PIXEL RENDERING SAME," filed Jan. 16, 2003, novel sub-pixel arrangements are therein disclosed for improving the cost/performance curves for image display devices and herein incorporated by reference.

These improvements are particularly pronounced when coupled with sub-pixel rendering (SPR) systems and methods further disclosed in those applications and in commonly owned United States Patents and Patent Applications: (1) U.S. Patent Application Publication 2003/0034992 (application Ser. No. 10/051,612) ("the '992 application"), entitled "CONVERSION OF A SUB-PIXEL FORMAT DATA TO ANOTHER SUB-PIXEL DATA FORMAT," filed Jan. 16, 2002; (2) U.S. Patent Application Publication 2003/0103058 (application Ser. No. 10/150,355) ("the '058 application"), entitled "METHODS AND SYSTEMS FOR SUB-PIXEL RENDERING WITH GAMMA ADJUSTMENT," filed May 17, 2002; (3) U.S. Patent Application Publication 2003/0085906 (application Ser. No. 10/215,843) ("the '906 application"), entitled "METHODS AND SYSTEMS FOR SUB-PIXEL RENDERING WITH ADAPTIVE FILTERING," filed Aug. 8, 2002; (4) U.S. Patent Application Publication 2004/0196302 (application Ser. No. 10/379,767), entitled "SYSTEMS AND METHODS FOR TEMPORAL SUB-PIXEL RENDERING OF IMAGE DATA" filed Mar. 4, 2003; (5) U.S. Patent Application Publication 2004/0174380 (application Ser. No. 10/379,765) ("the '380 application), entitled "SYSTEMS AND METHODS FOR MOTION ADAPTIVE FILTERING," filed Mar. 4, 2003; (6) U.S. Pat. No. 6,917,368 ("the '368 patent) (application Ser. No. 10/379,766), entitled "SUB-PIXEL RENDERING SYSTEM AND METHOD FOR IMPROVED DISPLAY VIEWING ANGLES" filed Mar. 4, 2003; (7) U.S. Patent Application Publication 2004/0196297 (application Ser. No. 10/409,413) ("the '297 application), entitled "IMAGE DATA SET WITH EMBEDDED PRE-SUBPIXEL RENDERED IMAGE" filed Apr. 7, 2003, which are hereby incorporated herein by reference.

BRIEF DESCRIPTION OF THE DRAWINGS

The accompanying drawings, which are incorporated in, and constitute a part of this specification illustrate exemplary implementations and embodiments of the invention and, together with the description, serve to explain principles of the invention.

DETAILED DESCRIPTION

Reference will now be made in detail to implementations and embodiments, examples of which are illustrated in the accompanying drawings. Wherever possible, the same reference number will be used throughout the drawings to refer to the same or like parts.

Figure 1A:
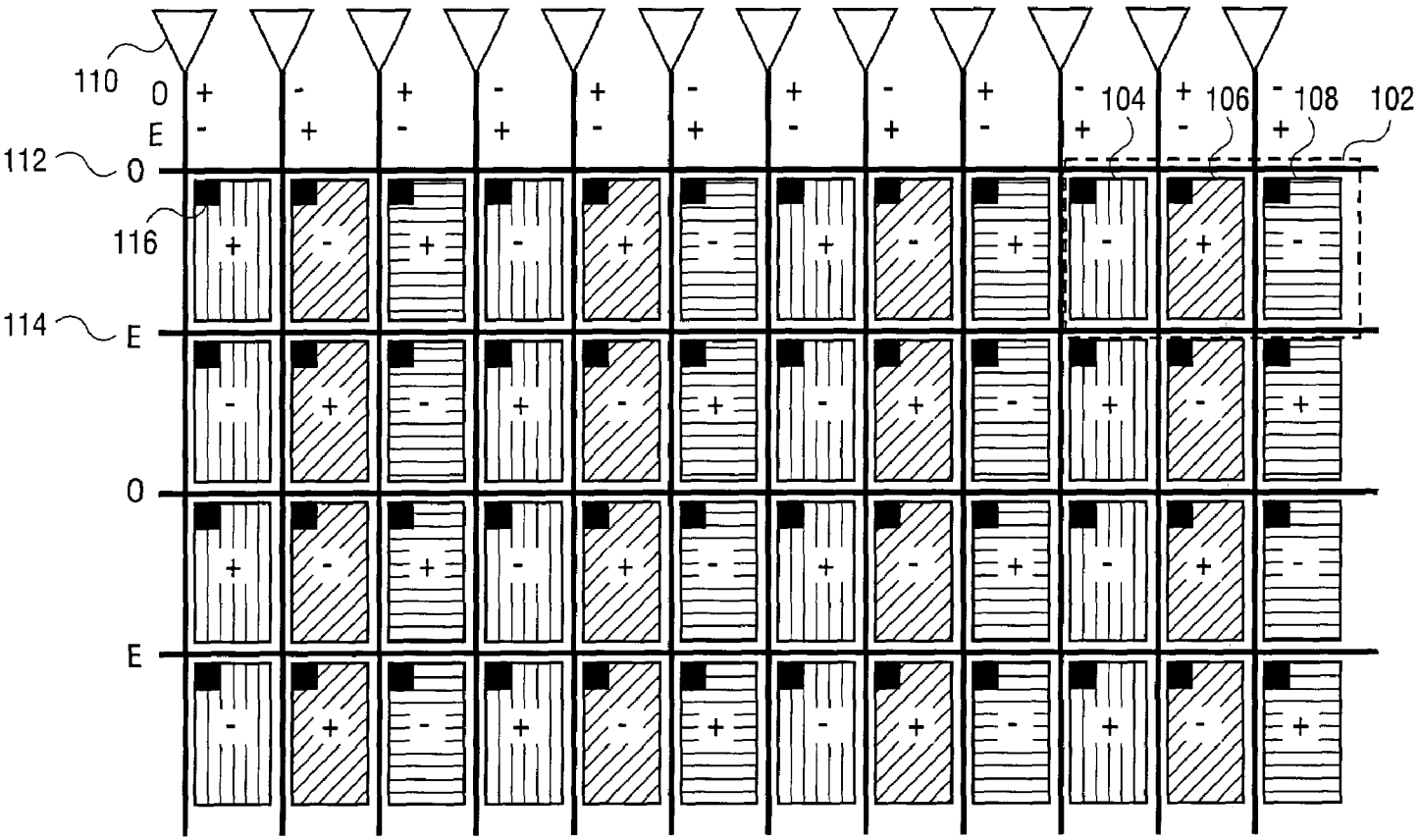
FIG. 1A (PRIOR ART)
FIG. 1A depicts a typical RGB striped panel display having a standard 1×1 dot inversion scheme.

FIG. 1A shows a conventional RGB stripe structure on panel 100 for an Active Matrix Liquid Crystal Display (AMLCD) having thin film transistors (TFTs) 116 to activate individual colored subpixels—red 104, green 106 and blue 108 subpixels respectively. As may be seen, a red, a green and a blue subpixel form a repeating group of subpixels 102 that comprise the panel.

As also shown, each subpixel is connected to a column line (each driven by a column driver 110) and a row line (e.g. 112 and 114). In the field of AMLCD panels, it is known to drive the panel with a dot inversion scheme to reduce crosstalk or flicker. FIG. 1A depicts one particular dot inversion scheme—i.e. 1×1 dot inversion—that is indicated by a "+" and a "−" polarity given in the center of each subpixel. Each row line is typically connected to a gate (not shown in FIG. 1A) of TFT 116. Image data—delivered via the column lines—are typically connected to the source of each TFT. Image data is written to the panel a row at a time and is given a polarity bias scheme as indicated herein as either ODD ("O") or EVEN ("E") schemes. As shown, row 112 is being written with ODD polarity scheme at a given time while row 114 is being written with EVEN polarity scheme at a next time. The polarities alternate ODD and EVEN schemes a row at a time in this 1×1 dot inversion scheme.

Figure 1B:
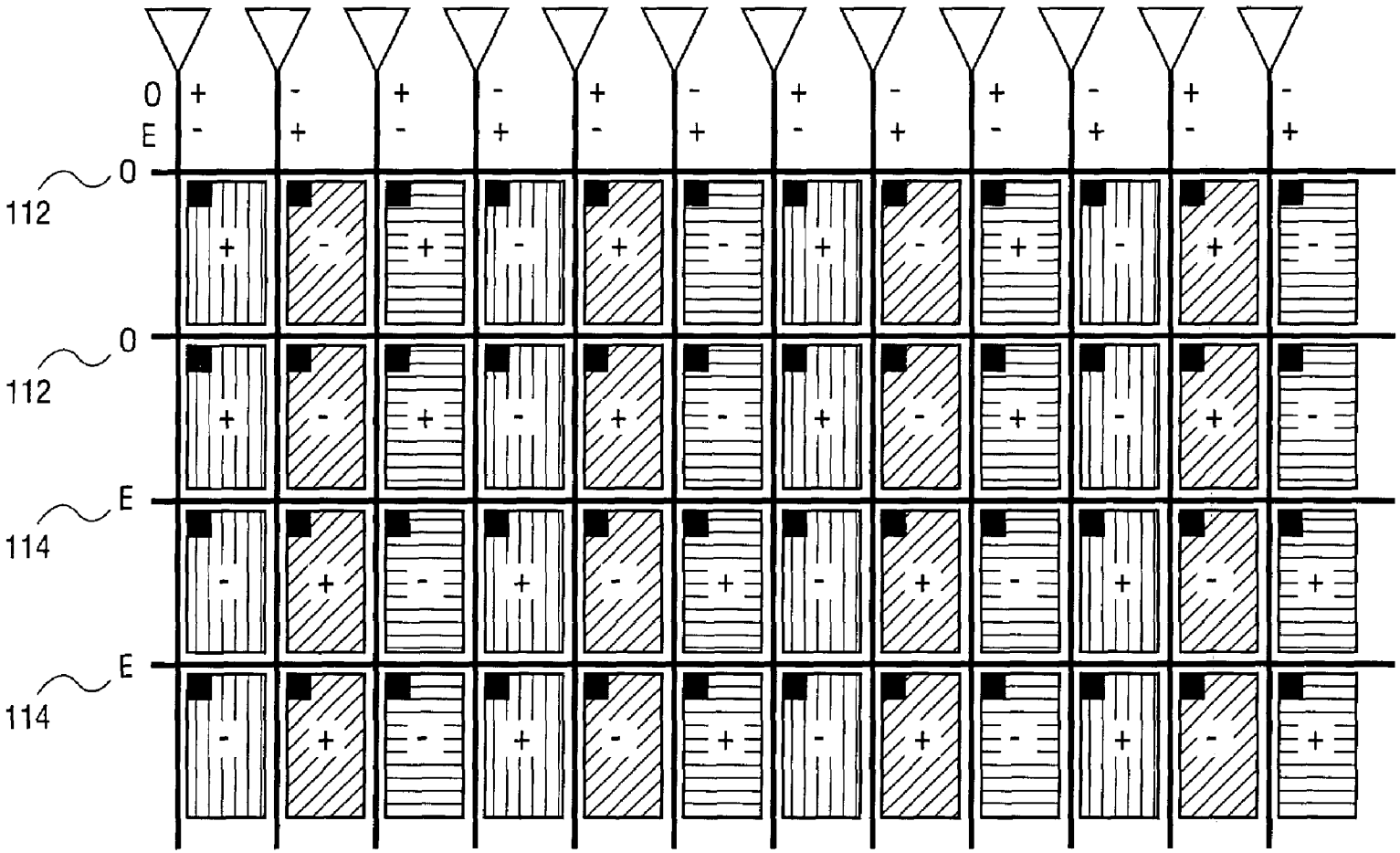
FIG. 1B (PRIOR ART)
FIG. 1B depicts a typical RGB striped panel display having a standard 1×2 dot inversion scheme.

FIG. 1B depicts another conventional RGB stripe panel having another dot inversion scheme—i.e. 1×2 dot inversion. Here, the polarity scheme changes over the course of two rows—as opposed to every row, as in 1×1 dot inversion. In both dot inversion schemes, a few observations are noted: (1) in 1×1 dot inversion, every two physically adjacent subpixels (in both the horizontal and vertical direction) are of different polarity; (2) in 1×2 dot inversion, every two physically adjacent subpixels in the horizontal direction are of different polarity; (3) across any given row, each successive colored subpixel has an opposite polarity to its neighbor. Thus, for example, two successive red subpixels along a row will be either (+,−) or (−,+). Of course, in 1×1 dot inversion, two successive red subpixels along a column with have opposite polarity; whereas in 1×2 dot inversion, each group of two successive red subpixels will have opposite polarity. This changing of polarity decreases noticeable visual effects that occur with particular images rendered upon an AMLCD panel.

Figure 2:
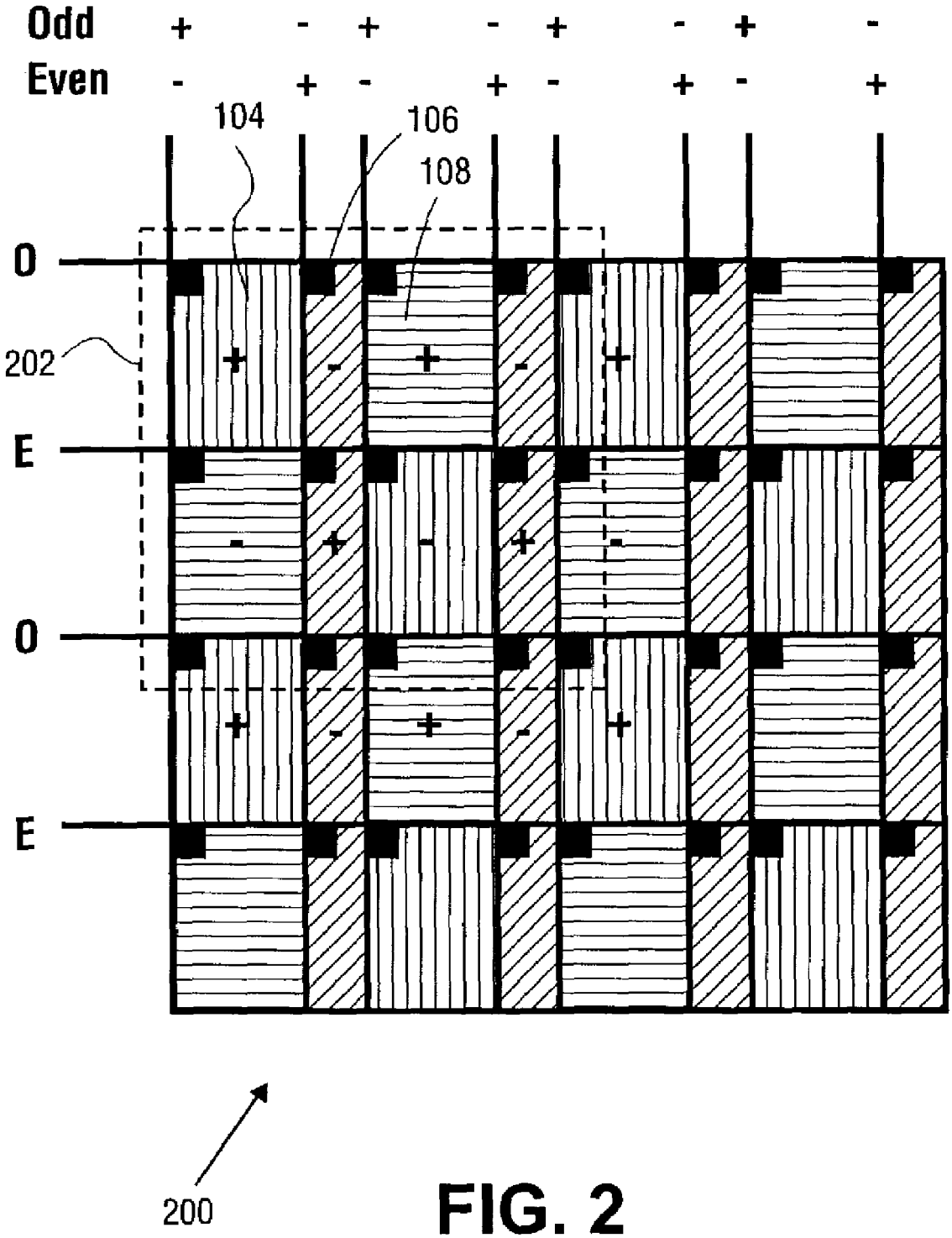
FIG. 2 depicts a novel panel display comprising a sub-pixel repeat grouping that is of even modulo.

FIG. 2 shows a panel comprising a repeat subpixel grouping 202, as further described in U.S. Patent Application Publication 2003/0128225. As may be seen, repeat subpixel grouping 202 is an eight subpixel repeat group, comprising a checkerboard of red and blue subpixels with two columns of reduced-area green subpixels in between. If the standard 1×1 dot inversion scheme is applied to a panel comprising such a repeat grouping (as shown in FIG. 2), then it becomes apparent that the property described above for RGB striped panels (namely, that successive colored pixels in a row and/or column have different polarities) is now violated. This condition may cause a number of visual defects noticed on the panel—particularly when certain image patterns are displayed. This observation also occurs with other novel subpixel repeating groups—for example, the subpixel repeat grouping in FIG. 1 of U.S. Patent Application Publication 2003/0128179—and other repeat groupings that are not an odd number of repeating subpixels across a row. Thus, as the traditional RGB striped panels have three such repeating subpixels in its repeat group (namely, R, G and B), these traditional panels do not necessarily violate the above noted conditions. However, the repeat grouping of FIG. 2 in the present application has four (i.e. an even number of) subpixels in its repeat group across a row (e.g. R, G, B, and G). It will be appreciated that the embodiments described herein are equally applicable to all such even modulus repeat groupings.

Figure 3:
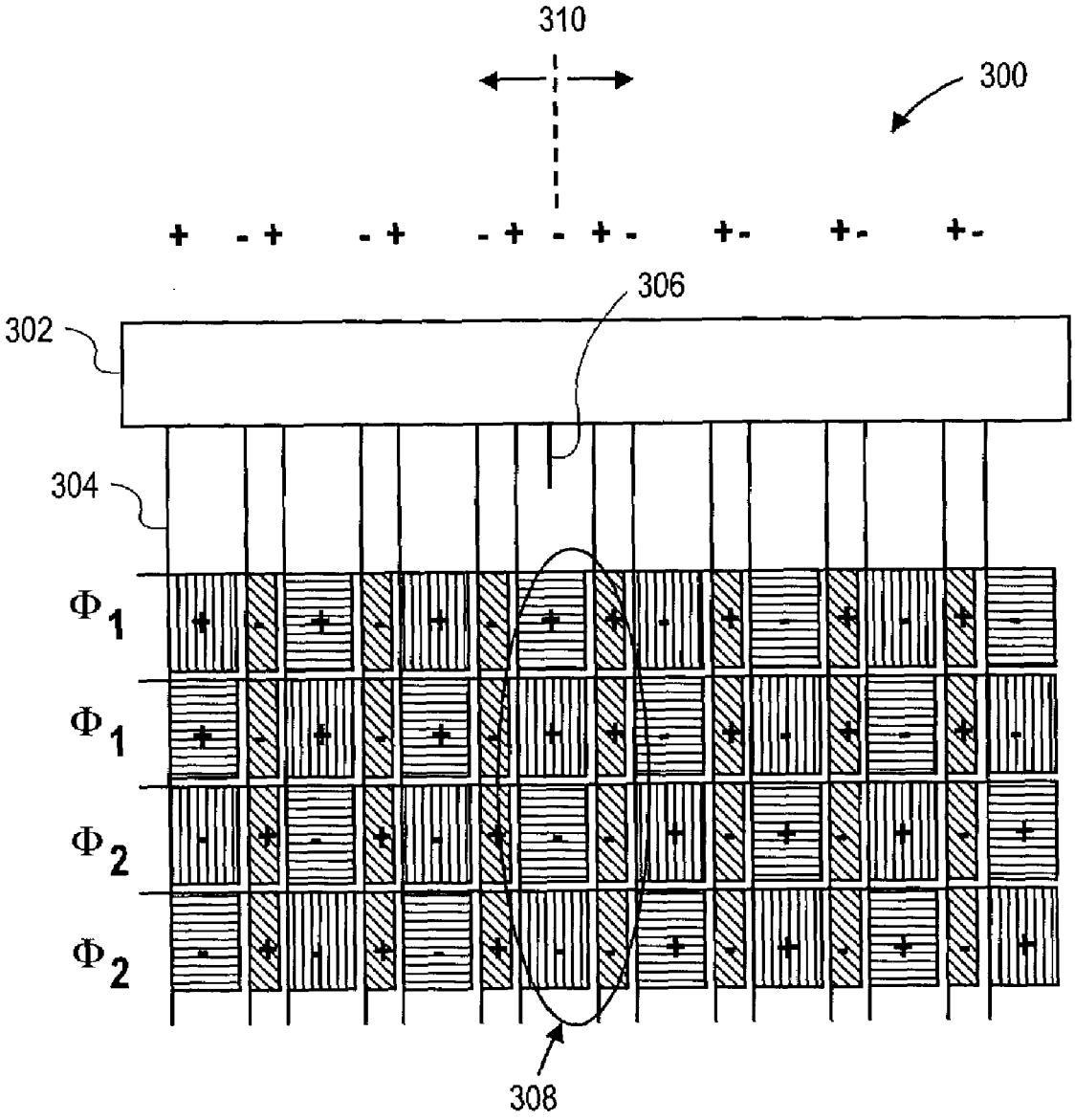
FIG. 3 depicts the panel display of FIG. 2 with one column driver skipped to provide a dot inversion scheme that may abate some undesirable visual effects; but inadvertently create another type of undesirable effect.
Figure 4:
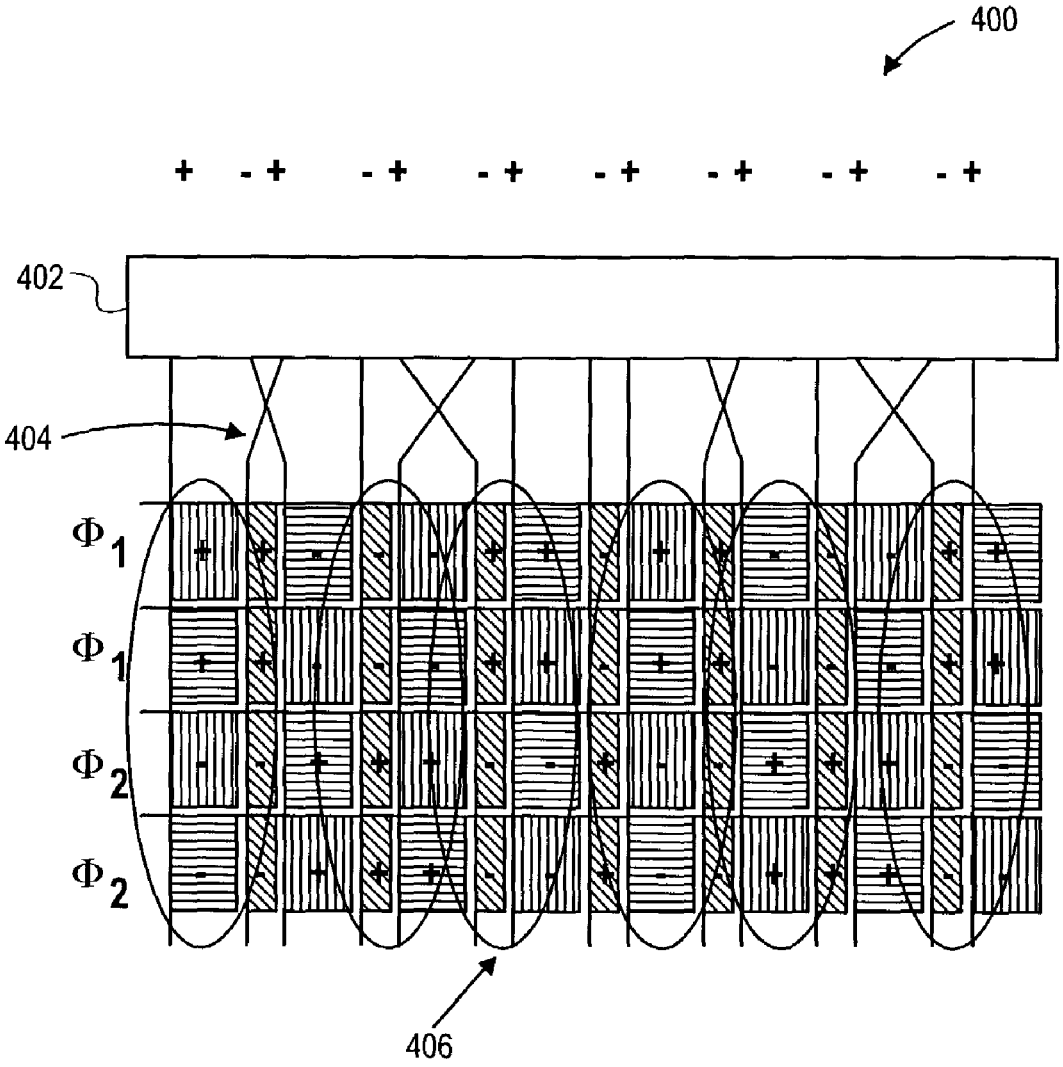
FIG. 4 depicts a panel whereby crossovers might create such an undesirable visual effect.
Figure 5:
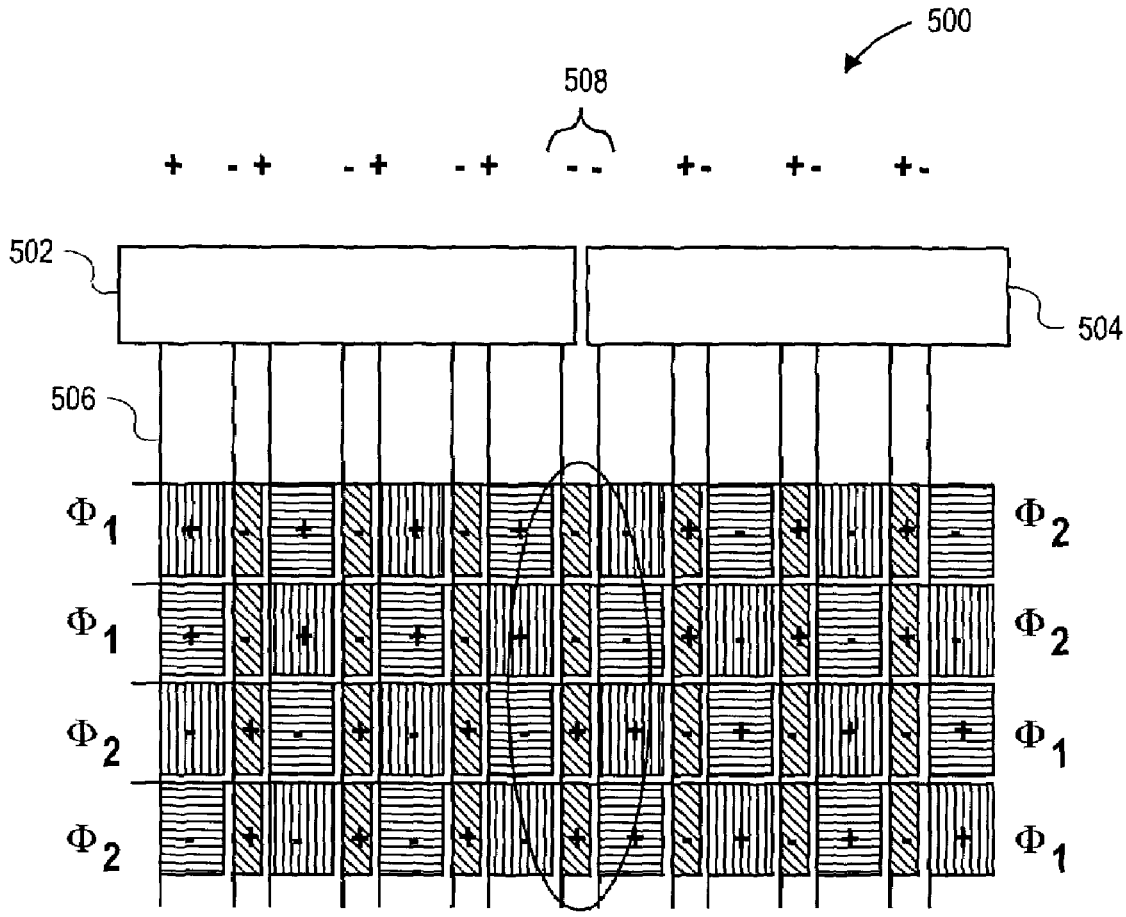
FIG. 5 depicts a panel whereby columns at the boundary of two column chip drivers might create an undesirable visual effect.

In several co-pending applications, e.g., the applications entitled "DISPLAY PANEL HAVING CROSSOVER CONNECTIONS EFFECTING DOT INVERSION" now published as U.S. Patent Application Publication 2004/0246381 and "SYSTEM AND METHOD OF PERFORMING DOT INVERSION WITH STANDARD DRIVERS AND BACKPLANE ON NOVEL DISPLAY PANEL LAYOUTS," now published as U.S. Patent Application Publication 2004/0246381, there are disclosed various techniques that attempt to solve the dot inversion problem on panels having even-modulo subpixel repeating groups. FIGS. 3 through 5 detail some of the possible techniques and solutions disclosed in those applications.

FIG. 3 shows panel 300 comprises the subpixel repeating group as shown in FIG. 2. Column driver chip 302 connects to panel 300 via column lines 304. Chip 302, as shown, effects a 1×2 dot inversion scheme on panel 300—as indicated by the "+" and "−" polarities indicated in each subpixel. As may be seen, at certain points along chip 302, there are column drivers that are not used (as indicated by short column line 306). "Skipping" a column driver in such a fashion on creates the desirable effect of providing alternating areas of dot inversion for same colored subpixels. For example, on the left side of dotted line 310, it can be seen that the red colored subpixels along a given row have the same polarity. However, on the right side of dotted line 310, the polarities of the red subpixels change. This change may have the desired effect of eliminating or abating any visual shadowing effects that might occur as a result of same-colored subpixel polarities. However, having two columns (as circled in element 308) driven with the same polarity may create an undesirable visual effect (e.g. possibly darker columns than the neighboring columns).

FIG. 4 shows yet another possible solution. Panel 400 is shown comprising a number of crossover connections 404 from a (possibly standard) column driver chip 402. As noted in the co-pending application entitled "DISPLAY PANEL HAVING CROSSOVER CONNECTIONS EFFECTING DOT INVERSION," these crossovers may also create undesirable visual effects—e.g. for the columns circled as in element 406.

FIG. 5 is yet another possible solution, as noted in the above co-pending application entitled "SYSTEM AND METHOD OF PERFORMING DOT INVERSION WITH STANDARD DRIVERS AND BACKPLANE ON NOVEL DISPLAY PANEL LAYOUTS," now published as U.S. Patent Application Publication 2004/0246381. Panel 500 is shown being driven by at least two column driver chips 502 and 504. Column lines 506 supply image data to the subpixels in the panel. At the boundary 508 between the two chips, the second chip is driven with the dot inversion polarity out of phase with the first chip, producing the dot inversion scheme as noted. However, the two adjacent column lines at the boundary 508 are driven with the same polarity down the column—possibly causing an undesirable visual effect as previously noted.

Although the above solutions possibly introduce visual effects that, if noticeable, might be detracting, these solutions share one common trait—the visual effects occur at places (e.g. chip boundaries, crossovers, etc) that are well known at the time of panel manufacture. Thus, it is possible to plan for and correct (or at least abate) these effects, so that it does not negatively impact the user.

In such cases, the panels at issue exhibit a visual image distortion that might be described as a "fixed pattern noise" in which the Electro-Optical (EO) transfer function for a subset of the pixels or subpixels is different, perhaps shifted, from another subset or subsets. This fixed pattern noise, if uncompensated, may cause an objectionable image if the differences are large. However, as disclosed herein, even these large differences may be advantageous in reducing quantization noise artifacts such as false contours, usually caused by insufficient grey scale depth.

Another source of the fixed pattern noise that is usually inadvertent and/or undesirable results from the differences in subpixel electrical parasitics. For example, the difference in parasitics may be the result of shifting the position or size of the Thin Film Transistor (TFT) or storage capacitor in an active matrix liquid crystal display (AMLCD). Alternatively, the fixed pattern noise may be deliberate on the part of the designer, such as adjusting the aperture ratio of the subpixels, or the transmittance of a color or polarizer filter. The aperture ratio may be adjusted using any single or combination of adjustments to the design of the subpixels, most notably the 'black matrix' used in some LCD designs. The techniques disclosed here may be used on any suitable pixelated or subpixelated display (monochrome or color).

In one embodiment, these two different sources of fixed pattern noise may give rise to two forms of EO difference. One form might be a linear shift, as might happen when the aperture ratio is different for the subsets. The other is a shift in the shape of the EO curve, as might happen in a difference of parasitics. Both may be adjusted via quantizing look-up tables ("LUTs") storing bit depth values, since the LUTs are a complimentary (inverse) function.

Since the pattern noise is usually predictable and/or measurable, one possible embodiment is to provide separate quantizers for each subset of pixels or subpixels, matched to the EO transfer function of each subset. One suitable quantizers in a digital system could be implemented as a look-up table (LUT) that converts a greater bit depth value to a smaller bit depth value. The large bit depth value may be in a subpixel rendering or scaling system. The large bit depth value may be in a linear luminance space or any arbitrary space encoding.

Figure 6:
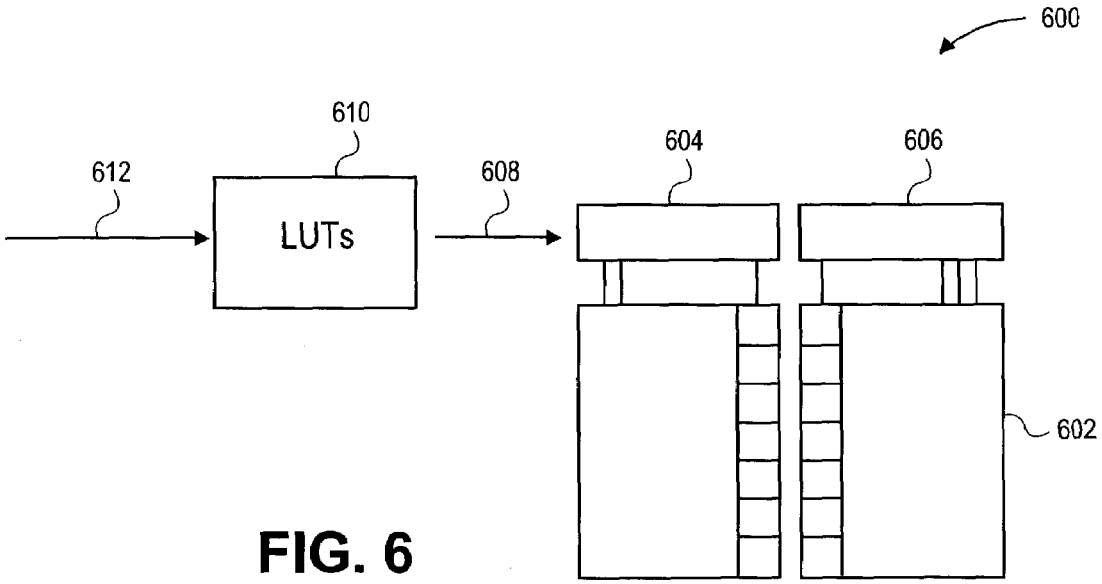
FIG. 6 is one embodiment of a system comprising a set of look-up tables that compensate for the undesirable visual effects introduced either inadvertently or as a deliberate design choice.

FIG. 6 is only one possible example of a system employing a LUT to correct for a given fixed pattern noise. Display 600 comprises a panel 602 that is being driven by at least two chips 604 and 606 wherein a possible fixed pattern noise is introduced at the chip boundary that might make the boundary columns darker than other neighboring columns. In this display, however, image data 612 that is to be rendered upon the panel is first passed through a set of LUTs 610 that will apply the appropriate quantizer for the appropriate subpixels on the panel. This image data 608 is then passed to the column drivers for rendering on the panel.

Figure 7:
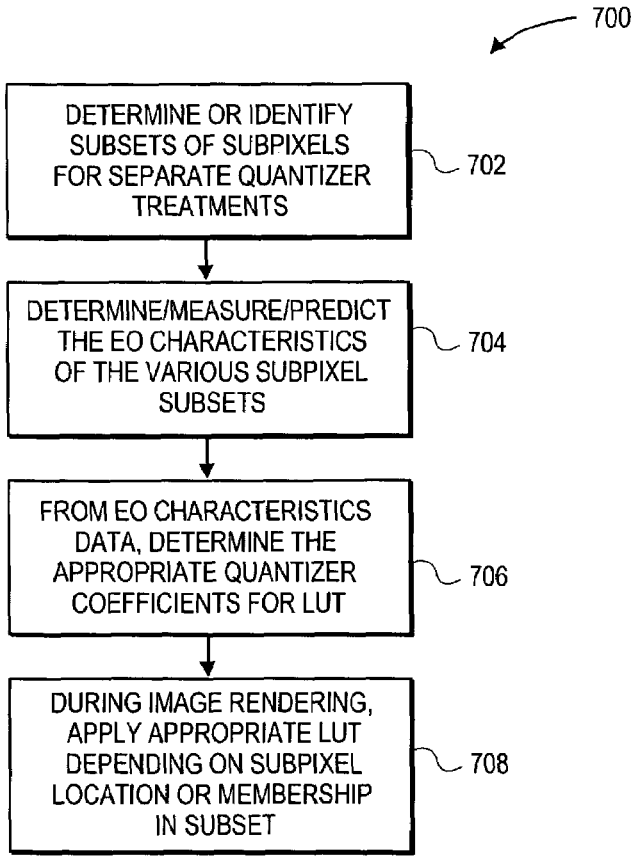
FIG. 7 is one embodiment of a flowchart for designing a display system that comprising look-up tables to correct visual effects.

FIG. 7 depicts one possible embodiment 700 of the present invention that implements appropriate LUTs. At step 702, determine or otherwise identify the subsets of subpixels that would qualify for different quantizer application. At step 704, determine, measure, or otherwise predict the EO characteristics of the various subpixel subsets. At step 706, from the EO characteristics data, determine the appropriate quantizer coefficients for each appropriate LUT. At step 708, apply the appropriate LUT to the image data to be rendered on the panel, depending on subpixel location or otherwise membership in a given subset.

Having separate LUTs not only compensates for the fixed pattern noise, but since each combination of subpixel subset and LUT quantizes (changes output) at different inputs, the effective grey scale of the display system is increased. The subsets need not be quantizing exactly out of step, not uniformly out of step, for improvement to be realized, though it helps if they are. The number of subsets may be two or more. More subsets increases the number of LUTs, but also increases the benefit of the quantization noise reduction and increased grey scale reproduction since each subset would be quantizing at different input levels.

Therefore it may be advantageous to deliberately introduce fixed pattern noise, using two or more subsets of EO transfer functions per subpixel color, preferably distributed evenly across the entire display. Since green is usually responsible for the largest percentage of luminance perception, having multiple subsets of green will increase the luminance grey scale performance. Having two or more subsets in red further increases the luminance grey scale performance, but to a lesser degree. However, having increases in any color, red, green, or blue, increases the number of colors that may be represented without color quantization error.

The fixed pattern noise may be large or small amplitude. If small, it may not have been visible without the matched quantizers; but the improvement in grey scale would still be realized with the matched quantizers. If the amplitude is large, the noise may be very visible, but with the matched quantizers, the noise is canceled, reduced to invisibility and the grey scale improved at the same time. The use of multiple quantizers may be combined with high spatiotemporal frequency noise added to the large bit depth values to further increase the performance of the system, the combination of the two providing greater performance than either alone. Alternatively, the multiple quantizers may be in combination with temporal, spatial, or spatio-temporal dithering.

Figure 8:
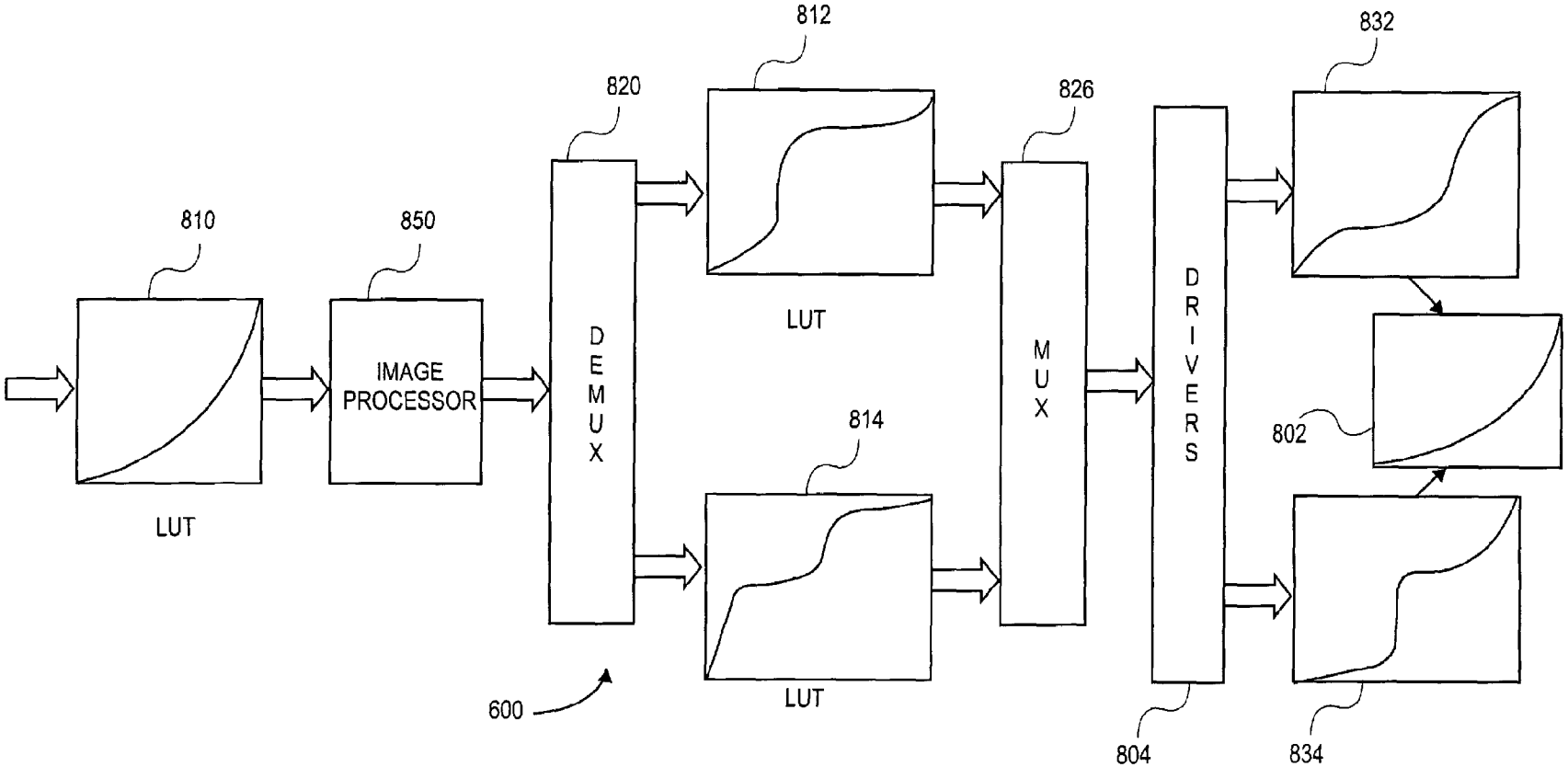
FIG. 8 is another embodiment of a system comprising look-up tables that compensate for a plurality of electro-optical transfer curves and provide reduced quantization error.

The advantage of reduction of quantization noise is considerable when a system uses lower grey scale drivers than the incoming data provides. However, as can be seen in FIG. 8, even for systems that use the same grey scale bit depth as the incoming data of the system, benefits may be seen in better control of the overall transfer function (gamma), by allowing an input gamma adjustment LUT 810 to set the display system gamma, while the output quantizers 812 and 814 exactly match and complement, thus cancel the EO transfer functions, 832 and 834 respectively, of the actual display device, with fidelity greater than the bit depth of the drivers due to the added benefit of the reduction of quantization noise. Thus, one may have an input LUT 810 that converts the incoming data to some arbitrarily larger bit depth, followed by any optional data processing 850 such as scaling or subpixel rendered data or not, then followed by conversion via the matched LUTs 832 and 834 to the subsets of pixels or subpixels. This might provide an improved gamma (transfer function) adjustment with reduced quantization noise since one subset will be switching state at a different point than another point or other points.

Examining FIG. 8 will allow this aspect of the invention to be better understood. In the figure, the transfer curve implemented in each of the LUTs, 810, 812, and 814, are shown graphically as continuous lines. It is to be understood that in fact this is a set of matched discrete digital numbers. The EO curves for the subsets of pixels or subpixels, 832 and 834, are similarly graphically represented by continuous curves. It is to be understood that when in operation the drivers 804 convert digital numbers into a limited set of analog voltages, pulse widths, current, or other suitable display modulation means.

An incoming signal 810 with a given bit depth is converted to a greater bit depth and is simultaneously impressed with the desired display system gamma curve by the incoming LUT 810. This is followed by any desired image processing step 850 such as subpixel rendering, scaling, or image enhancement. This is followed by a suitable means for selecting the appropriate LUT (812 or 814) for the given pixel or subpixel, herein represented as a demux circuit element 820. This element may be any suitable means known in the art. Each subset is then quantized to a lower bit depth matching that of the subsequent display device system 804 such as display driver chips by LUTs 812 and 814. Each of these LUTs 812 and 814 has a set of paired numbers that are generated to serve as the inverse or complementary function of the matching EO curves 832 and 834 respectively. When these values are used to select the desired brightness or color levels of each subset, the resulting overall display system transfer curve 802 is the same as that of the incoming LUT 810. Following the output gamma compensation LUTs 812 and 814 is a means 826 for combining the results, herein represented as a mux, of the multiple LUTs 812 and 814 to send to the display drivers 804.

Special note should be taken of the nature of the EO curve difference and the desired behavior in the case of an even image field at the top of the value range. For example, in the case of a text based display where it is common to display black text on a white background, the even quality of the white background is highly desirable. In such a case, the brightness level of the darkest subset of pixels or subpixels will determine the highest level to which the brighter subsets will be allowed to proceed, given sufficient quantizer steps to equalize at this level. This may of necessity lead to lost levels above this nominally highest level, for the brighter subset(s). Another case might be handled differently, for example, for television images, the likelihood of an even image field at the top of the value range is reasonably low, (but not zero). In this case, allowing the top brightness of the brighter subset(s) to exceed that of the lowest subset may be acceptable, even desirable, provided that all levels below that are adjusted to be the same per the inventive method described herein.

It should also be noted that it may be desirable, due to different EO curves for different colors, that each color have its own quantizing LUT. There may be different EO subset within each color subset per the present invention. It may be desirable to treat each color differently with respect to the above choices for handling the highest level settings. For example, blue may be allowed to exhibit greater differences between subsets than green or red, due to the human vision system not using blue to detect high spatial frequency luminance signals.

Furthermore, it should be understood that this system may use more than two subsets to advantage, the number of LUTs and EO curves being any number above one. It should also be understood by those knowledgeable in the art, that the LUTs may be substituted by any suitable means that generates the same, or similar, output function. This may be performed as an algorithm in software or hardware that computes, or otherwise delivers, the inverse of the display subset EO curves. LUTs are simply the means of choice given the present state of art and its comparative cost structure. It should also be further understood, that while FIG. 8 shows a demux 820 and mux 826, any suitable means for selecting and directing the results of the multiple LUTs or function generator may be used. In fact, the entire system may be implemented in software running on a general purpose or graphics processor.

The implementation, embodiments, and techniques disclosed herein work very well for liquid crystal displays that have different regions of subpixels having different EO characteristics—e.g. due to dot inversion schemes imposed on panels have an even number of subpixels in its repeating group or for other parasitic effects. It should be appreciated, however, that the techniques and systems described herein are applicable for all display panels of any different type of technology base—for example, OLED, EL, plasma and the like. It suffices that the differences in EO performance be somewhat quantifiable or predictable in order to correct or adjust the output signal to the display to enhance user acceptability, while at the same time, reduce quantizer error.

What is claimed is:

1. A display comprising:

a panel substantially comprising a subpixel repeating group having an even number of subpixels in a first direction; wherein a polarity inversion signal applied to the panel produces different electro-optical properties for at least two subsets of same-colored subpixels; and separate quantizers for each of the at least two subsets of same-colored subpixels.

2. The display of claim 1, wherein each separate quantizer comprises a look-up table storing data values.

3. The display of claim 2, wherein the data values in the look-up table correct for fixed pattern noise.

4. A method of correcting for subsets of same-colored subpixels having different electro-optical properties in a display panel, the method comprising:

determining electro-optical properties of at least two subsets of same-colored subpixels by testing subsets of same-colored subpixels across the panel to determine which subsets of same-colored subpixels have different electro-optical properties;

determining appropriate correction factors to apply to each subset; and during image rendering, applying appropriate correction factors to output signals of a given subset.

5. The method of claim 4, wherein determining the electro-optical properties of at least two subsets further comprises:

identifying adjacent columns of subpixels that have same polarity signals being applied at a same time.

6. The method of claim 4, wherein determining the appropriate correction factors to apply further comprises:

adjusting an amount of corrective signal to apply to a given subset; and testing an output of the panel during image rendering.

7. The method of claim 4, wherein the corrective factors include a look-up table of data values.

8. A display system comprising:

a display panel having a plurality of subpixels having at least two colors and including green subpixels; and at least two pairs of matched quantizers each supplying adjusted data values to respective subsets of said green subpixels on the panel.

9. The display system of claim 8, wherein the at least two pairs of matched quantizers increase an effective grey scale of the display system.

10. The display system of claim 8, wherein the at least two pairs of matched quantizers reduce quantization errors of the display system.

11. The display system of claim 8, wherein high spatial frequency noise is added to the display system for use in combination with the at least two pairs of matched quantizers.

12. The display system of claim 8, wherein dithering signals are added to the display system for use in combination with the at least two pairs of matched quantizers.

13. A display comprising:

a panel comprising a plurality of subpixels; wherein the panel has at least two subsets of same-colored subpixels having different electro-optical properties; wherein the at least two subsets of same-colored subpixels have different parasitic effects that produce the different electro-optical properties for the at least two subsets; and separate quantizers for each of the at least two subsets of same-colored subpixels.

14. The display of claim 13, wherein each separate quantizer comprises a look-up table storing data values.

15. The display of claim 14, wherein the data values in the look-up table correct for fixed pattern noise.

16. A display comprising:

a panel comprising a plurality of subpixels; wherein the panel has at least two subsets of same-colored subpixels having different electro-optical properties; and separate quantizers for each of the at least two subsets of same-colored subpixels; wherein the separate quantizers substantially convert greater bit depth values to smaller bit depth values for certain subsets of subpixels.

17. The display of claim 16, wherein each separate quantizer comprises a look-up table storing data values.

18. The display of claim 17, wherein the data values in the look-up table correct for fixed pattern noise.

19. A display system comprising:

a display panel having a plurality of subpixels having at least two colors and including red subpixels; and at least two pairs of matched quantizers each supplying adjusted data values to subsets of said red subpixels on the panel.

20. The display system of claim 19, wherein the at least two pairs of matched quantizers increase an effective grey scale of the display system.

21. The display system of claim 19, wherein the at least two pairs of matched quantizers reduce quantization errors of the display system.

22. The display system of claim 19, wherein high spatial frequency noise is added to the display system for use in combination with the at least two pairs of matched quantizers.

23. The display system of claim 19, wherein dithering signals are added to the display system for use in combination with the at least two pairs of matched quantizers.

24. A display system comprising:

a display panel having a plurality of subpixels having at least two colors; and at least two pairs of matched quantizers each supplying adjusted data values to subsets of same-colored subpixels on the panel; wherein a first one of each pair of matched quantizers represents an electro-optical transfer function for one of the subsets of same-colored subpixels, and a second one of each pair of matched quantizers represents an inverse of the electro-optical transfer function.

25. The display system of claim 24, wherein the at least two pairs of matched quantizers increase an effective grey scale of the display system.

26. The display system of claim 24, wherein the at least two pairs of matched quantizers reduce quantization errors of the display system.

27. The display system of claim 24, wherein high spatial frequency noise is added to the display system for use in combination with the at least two pairs of matched quantizers.

28. The display system of claim 24, wherein dithering signals are added to the display system for in combination with the at least two pairs of matched quantizers.

29. A display system comprising:

a display panel having a plurality of subpixels having at least two colors; and at least two pairs of matched quantizers each supplying adjusted data values to subsets of same-colored subpixels on the panel; wherein one of each pair of matched quantizers is an output quantizer positioned to provide adjustment values to one subset of same-colored subpixels prior to the same-colored subpixels being provided to display drivers.

30. The display system of claim 29, wherein the at least two pairs of matched quantizers increase an effective grey scale of the display system.

31. The display system of claim 29, wherein the at least two pairs of matched quantizers reduce quantization errors of the display system.

32. The display system of claim 29, wherein high spatial frequency noise is added to the display system for use in combination with the at least two pairs of matched quantizers.

33. The display system of claim 29, wherein dithering signals are added to the display system for use in combination with the at least two pairs of matched quantizers.

34. A display system comprising:

a display panel having a plurality of subpixels having at least two colors; and at least two pairs of matched quantizers each supplying adjusted data values to subsets of same-colored subpixels on the panel; wherein one of each pair of matched quantizers represents an electro-optical transfer function of the panel positioned to provide adjustment values to one subset of same-colored subpixels after the same-colored subpixels have been provided to display drivers.

35. The display system of claim 34, wherein the at least two pairs of matched quantizers increase an effective grey scale of the display system.

36. The display system of claim 34, wherein the at least two pairs of matched quantizers reduce quantization errors of the display system.

37. The display system of claim 34, wherein high spatial frequency noise is added to the display system for use in combination with the at least two pairs of matched quantizers.

38. The display system of claim 34, wherein dithering signals are added to the display system for use in combination with the at least two pairs of matched quantizers.

* * * * *